United States Patent [19]

Kaiser

[11] Patent Number: 4,664,020

[45] Date of Patent: May 12, 1987

[54] PISTON-CYLINDER STRUCTURE

[75] Inventor: Siegmund H. Kaiser, Nürtingen, Fed. Rep. of Germany

[73] Assignee: PROMA Produkt-und Marketing Gesellschaft m.b.H., Plochingen, Fed. Rep. of Germany

[21] Appl. No.: 383,795

[22] Filed: Jun. 1, 1982

[30] Foreign Application Priority Data

Jun. 25, 1981 [DE] Fed. Rep. of Germany ..... 3124878
Jun. 25, 1981 [DE] Fed. Rep. of Germany ..... 3124915

[51] Int. Cl.[4] ..... F01B 29/00
[52] U.S. Cl. ..... 92/88; 277/DIG. 7
[58] Field of Search ..... 92/88, 165, 169; 277/DIG. 7, 237, 170; 244/63

[56] References Cited

U.S. PATENT DOCUMENTS

| | | | |
|---|---|---|---|
| 2,473,430 | 6/1949 | Hoffar . | |
| 2,603,190 | 7/1952 | Mitchell | 92/88 |
| 2,721,539 | 10/1955 | Mitchell | 92/88 |
| 3,019,813 | 2/1962 | Dommann | 92/88 |
| 3,454,242 | 7/1969 | Feder et al. | 92/88 |
| 4,313,609 | 2/1982 | Clements | 277/237 R |
| 4,373,427 | 2/1983 | Garlapaty et al. | 92/88 |

FOREIGN PATENT DOCUMENTS

| | | |
|---|---|---|
| 804632 | 4/1951 | Fed. Rep. of Germany . |
| 843482 | 5/1952 | Fed. Rep. of Germany . |
| 846493 | 6/1952 | Fed. Rep. of Germany . |
| 1475809 | 3/1969 | Fed. Rep. of Germany . |
| 2453948 | 5/1975 | Fed. Rep. of Germany . |
| 2162572 | 5/1976 | Fed. Rep. of Germany . |
| 2908605 | 9/1980 | Fed. Rep. of Germany . |
| 7244052 | 7/1974 | France . |
| 83708 | 8/1971 | German Democratic Rep. . |

*Primary Examiner*—Robert E. Garrett
*Attorney, Agent, or Firm*—Frishauf, Holtz, Goodman & Woodward

[57] ABSTRACT

To provide for effective sealing of a movable piston in a cylinder formed with a longitudinal slit, a motion transfer element (9, 10, 11, 12) is coupled to the piston (5) extending through the slit (3) and shaped in form of a yoke (11) extending over and around the outer surfaces of the cylinder tube (1), to retain the portions of the tube separated by the slit. The slit is sealed in the region between sealed ends (4) of the cylinder and the piston heads (6, 7) of the piston by a pair of separable and re-engageable plastic strips (18, 27), the inner strip (18) being formed with a projecting headed ridge (26) fitting in a snap-in groove (30) defined by two legs (29) extending from the outer strip. Upon movement of the piston (5), a wedge-shaped separating element (36) separates the interengaged ridge-groove combination ahead of the movement, and a top pressing element (37) coupled to the yoke (11) re-seals the headed ridge (26) in the groove (30) at the trailing side to form sealed cylinder chambers (19, 20) and retain the cylinder chambers in sealed condition upon movement of the piston, and with it the yoke and the separating wedge. The strips may be made of plastic to permit resilient deflection and engagement of the ridge (26) in the groove (30).

32 Claims, 5 Drawing Figures

PISTON-CYLINDER STRUCTURE

The present invention relates to a piston-cylinder structure, and more particularly to the type of piston-cylinder structure in which the piston does not have an axially extending piston rod but, rather, the cylinder is formed with an axially extending slit through which a force and/or motion transmitting element extends, secured to the piston and traveling therewith. Means are provided to prevent the escape of pressure fluid from the axially extending slit upon movement of the piston in the cylinder.

BACKGROUND

Cylinder-piston arrangements which do not use piston rods have a particular advantage: they require only little longitudinal space, and, additionally, have the advantage that problems associated with the piston rod extending from the cylinder are avoided, for example damage to the surface of the piston rod, bending thereof, or the like. The force applied to the piston by a pressure fluid, which may be hydraulic or gaseous, is directly transferred by the piston on an externally extending force transmission element, guided in a longitudinal slit of the cylinder tube. The slit, through which the force transmission element extends, must be sealed. Sealing of the pressure spaces at both sides of the piston is effected in radial direction with respect to the cylinder tube by sealing rings or sealing sleeves formed on the piston; the longitudinal slit of the cylinder tube is sealed by a sealing strip which, in the unpressurized region, is guided between the piston seals and the force transmitting element.

Sealing of the longitudinal slit presents problems. It has been proposed—see German Pat. No. DE-PS 843 482—to provide a sealing strip of essentially rectangular cross section, located in an interior longitudinal groove which, also, forms lateral guide surfaces for the sealing strip. The pressure within the cylinder, when pressurized, presses the sealing strip against the engagement surface. Practical experience has shown, however, that it is difficult to prevent the sealing strip, when unpressurized, to hang-through into the pressure chamber, since, otherwise, upon admission of pressure fluid, an initial leakage thereof will result. Hang-through is practically unavoidable.

Another cylinder of this type is described in German Pat. No. DE-PS 846 493, in which a sealing strip having essentially U-shaped cross section is used. The flange of the sealing strip is fitted in corresponding recesses within the interior wall of the cylinder tube, in order to improve sealing of the pressure spaces and simultaneously to improve sealing of the pressure spaces and simultaneously to improve the resistance of the cylinder tube with respect to expansion of its diameter upon pressurization. This, however, results in an extremely expensive and complex structure, difficult to make, entirely apart from the fact that the piston must have a particular and special construction in order to permit guidance of the sealing strip with its flanges in the respective recesses of the cylinder.

It has been proposed to simplify such an arrangement—see German Pat. No. DE-PS 21 62 572—to make the cylinder of a non-magnetic material which, at least in one of the wall regions parallel to the longitudinal slit, has a magnetic body, and to associate therewith a sealing strip made of magnetizable material. in order to be attracted by the magnet of the magnet body. Such a sealing strip is metallic; micro-leakage is practically unavoidable, so that this type of cylinder seal can hardly be used with liquids; such a cylinder, practically, thus can be used only with compressed air. In practice, it has been found that the magnet elements used to hold the sealing strip also attract extraneous ferrous articles, such as iron chips and the like, which interferes with proper positioning of the sealing strip and, generally, may lead to substantial operating interruptions. The sealing strip which is used is a very thin metal tape or web which is not laterally guided by the magnetic elements. Under some operating conditions, the metal tape can be laterally shifted which may lead to explosive dislocation of the strip, upon pressurization, and thus presents a substantial hazard in operation.

It has been proposed to utilize a metallic covering strip located at the outside of the cylindrical tube at both sides of the force transmitting element, covering the longitudinal slit. This cover strip is used to cover the longitudinal slit towards the outside, and thus prevent penetration of dirt and the like therein. Such a metallic cover strip can be held by magnetic elements. Magnetic holding of strips within, as well as without, the cylinder tube is expensive, however, since special steel strips must made, accurately ground to size to match the cylinder and the surfaces to be covered or sealed.

The Invention

It is an object to provide a cylinder-piston structure of the type having a longitudinal slit through which an attachment for an operating element or force transfer element extends, coupled to the piston, and in which the seal of the remaining exposed slit can be readily effected by a simple sealing structure which is efficient and inexpensive.

Briefly, the piston-cylinder structure is sealed by a pair of flexible sealing strips which have elongated interengaging projection-and-recess means, such as an elongated ridge formed on the strip located inside of the piston, and engaging an elongated groove formed in the outer one of the strips. The strips may be made of plastic, and are so positioned with respect to the operating element attached to the piston that, upon movement of the piston, the operating element separates the strips from each other at one side, while reclosing the projection-and-recess ridge and groove at the other, so that a continuous effective seal of the slit at the pressure zones or pressure chambers of the cylinder is provided.

DRAWINGS

Figure 1:
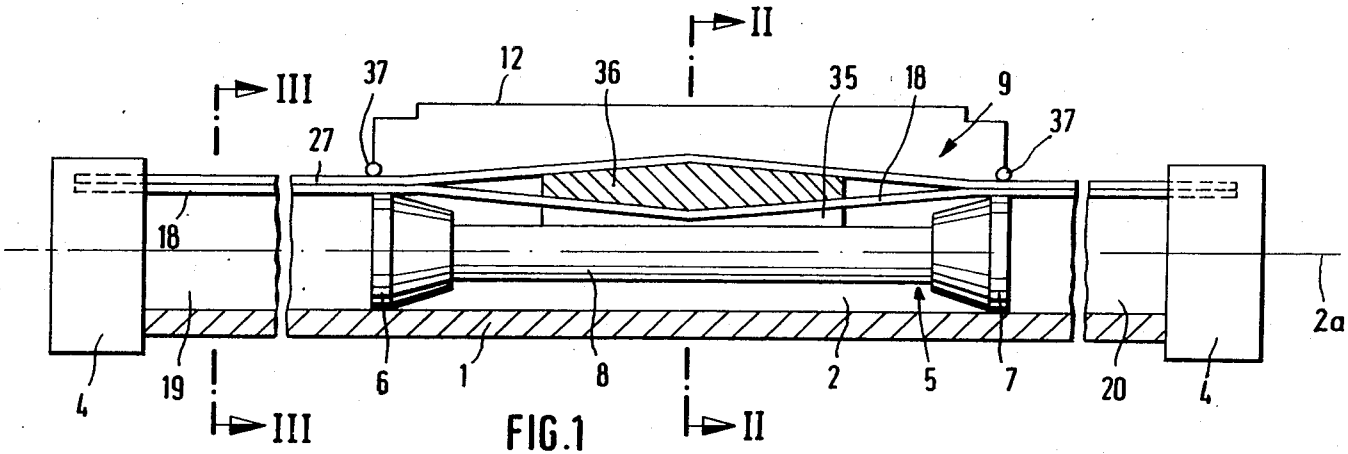
FIG. 1 is an axial cross section of a piston-cylinder arrangement, omitting all elements not necessary for an understanding of the present invention.

The cylinder 1 is formed with an eccentrically positioned cylinder bore 2. Cylinder bore 2 has an axis 2*a* (FIG. 1) which is eccentric with respect to the axis of symmetry 1*a* of the cylinder tube 1. The cylinder tube 1 has upper and lower parallel flat surfaces 1*b*, 1*c*. It is formed with a longitudinal slit 3. The cylinder tube 1 is closed off at both ends by end covers 4, to provide a pressure-tight seal. A piston 5 is slidable within the cylinder tube 1. The piston 5 has piston sealing rings or sealing sleeves 6, 7 adjacent its end faces, in order to provide a seal with respect to the inner wall of the cylinder bore 2. The piston 5 is made of reduced diameter in the region between the piston heads surrounded by the sealing rings or sleeves 6, 7; the zone of reduced diameter is seen at 8. A force and motion transfer element 9 (FIG. 2) is secured to the intermediate or reduced zone or section 8 of the piston, for example by a screw connection, not further illustrated. The force transfer element 9 extends through the slit 3, with slight lateral play, and has an externally projecting rib-like part 10 which is joined to a yoke 11, laterally surrounding the cylinder tube 1. The yoke 11 is formed with spaced parallel flanges 12 which permit coupling the piston, and hence the force transferring element, to an external apparatus or device, to be moved and operated in accordance with pressure fluid introduced into chambers 19, 20, respectively, between the end caps 4 and the end faces of the piston heads surrounded by the sealing elements 6, 7. Piston 5 is double-headed.

The yoke 11, in cross section, is an essentially U-shaped structure which has guide strips 14 secured thereto in the region of its legs 13, fitting into corresponding guide grooves 16 formed in the cylinder tube 1, and slidable therein. The position of the guide strips 14 can be adjusted by adjustment at holding screws 15. The two legs 13, alternatively, can be extended towards the bottom wall surface 1*c*; since this is not a necessary construction, however, only one such extension is shown in chain-dotted lines at the left side of FIG. 2, together with an additional guide strip 14*a*. The extension 17 retains the guide strip 14*a*, which is also retained and positioned by screws 15. The guide strips 14 and, if used, 14*a*, provide for parallel guidance and movement of the force transfer element 9 and simultaneously prevent expansion of the cylinder tube 1 in the region of the longitudinal slit 3, particularly upon being pressurized.

Figure 3:
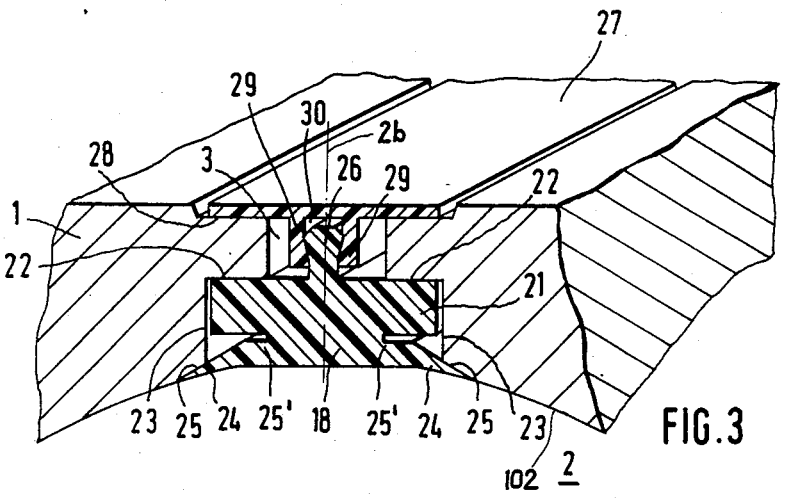
FIG. 3 is a part-perspective cross section along lines III—III of FIG. 1.
Figure 4:
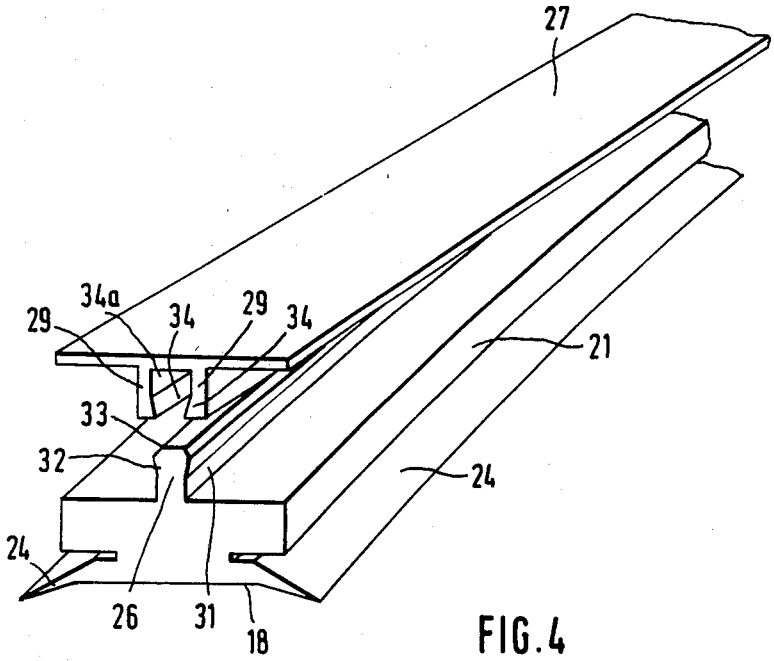
FIG. 4 is a perspective view of the sealing strip and illustrating structural details of the cylinder structure and guidance of the force transferring or force transmitting element.

The slit 3 is sealed by a two-element sealing arrangement, having a first flexible inner sealing strip 18 and a second flexible outer sealing strip 27—see FIGS. 1, 3 and 4. The sealing strips are secured in the end covers 4. The sealing strip element 18 seals the longitudinal slit 3 in the region of the pressure chambers located between the piston 5 and the respective end covers 4 so that, upon admission of pressurized fluid in the chambers 19, 20, the respective cylinder will be entirely closed. The sealing strip 18 extends over the entire length of the cylinder tube 1. As best seen in FIGS. 3 and 4, the sealing strip 18 has a base or guide element 21 of essentially rectangular configuration which can fit into the base of a longitudinal groove, forming a sealing surface 22 (FIG. 3) and furthermore guided laterally by guide surfaces 23 formed on the groove. The side of the strip 18 facing the piston is formed with elastic sealing lips 24, tapering, wedge-like, to ends matching the curvature of the cylinder wall 102. The sealing lips 24 are movably connected at their roots 25' on the guide portion 21, the entire sealing strip forming, for example, a single molded unit of plastic. The sealing lips 24 engage against matching sealing surfaces 25, machined on the wall 102; preferably, the arrangement is so made that the sealing strip 18 matches and fit snugly, without gap, to complement the circumference of the inner wall 102 of the cylinder bore 2.

The upper side of the sealing strip 18, that is, above the guide portion 21 thereof, is formed with a longitudinally centrally located rib 26 which extends within the longitudinal slit 3 symmetrically with respect to the central longitudinal axis 2*b* of the bore 2 of the cylinder 1. The rib 26, preferably, also is unitary with the strip 18. The outer side of the cylinder tube 1 is closed off by a flexible elastic plastic cover strip 27 which, likewise, extends throughout the length of the cylinder tube 1 and is secured with its ends in the the end covers 4. The cover strip 27 is approximately rectangular, in cross section, and is positioned in a corresponding longitudinal groove 28 formed in the upper wall 1*b* of the cylinder tube 1, from the bottom of which the longitudinal slit 3 extends. The cover strip 27 has two projecting legs 29 which, between themselves, define a longitudinal groove 30, of essentially U shape in cross section, and which is dimensioned to receive the rib 26. Like rib 26, the U-shaped groove extends throughout the entire length of the cover strip 27, or of the sealing strip 18, respectively. The rib 26 and the U-shaped groove 30 defined by the top cover strip 27 and its projecting legs 29 form a projection-and-recess interengaging arrangement.

The ribs 26 of the inner sealing strip 18 is best seen in FIG. 4; initially, upon projection from the transversely extending portion 21, it is formed with an element having essentially straight upstanding flanks 31, which merges into a slightly outwardly diverging wedge-shaped part 32 which, in turn, merges with a converging end portion 33 which, essentially, is trapezoidal in cross section. Thus, the rib 31 is formed with a somewhat enlarged head, with a relieved or chamfered top, which may also be rounded, in order to facilitate introduction of the rib into the U-shaped groove. In corresponding manner, the longitudinal groove 30 is so shaped that the projecting legs 29 are slightly enlarged at their bottom, to form converging tip portions facing each other, and converging towards the opening of the groove 30, to grip around the somewhat enlarged head of the rib 26.

The rib 26 can thus be continuously pressed into the longitudinal groove 30 upon elastic lateral deflection of the legs 29 of the cover strip 27, as clearly seen in FIG. 4. A secure, leak-proof connection between the cover strip 27 and the sealing strip 18 will result, since the wedge surfaces 34 on the U-shaped legs 29, and wedge surfaces 32 on the rib 26, when joined together, form reentrant elements which lock above and around each other. The chamfered portion 33 of the head of the rib 26 facilitates engagement of the rib 26 into the groove 30; the straight portions 31 and 34*a* of the flanks defining the projection, as well as the recess, respectively, insure matching engagement of the wedge-shaped parts 32, 34.

Various changes may be made in the sealing arrangement; for example, rather than forming a single ridge 26 fitting into a coordinate groove 30, a plurality of parallel positioned ridges and longitudinal grooves may be used; the position, of course, can also be reversed, for example forming the ridge 26 on the cover strip 27 and laterally positioned legs gripping around the ridge on the inner strip 18, in which arrangement, of course, also a plurality of parallel located strips can be used. Likewise, a combination of ridges and grooves, defined by parallel extending ridges from both the strips 18 and 27 can be used, to form, on the one side, a ridge similar to ridge 26 and a leg part 29 for a channel or groove 30 adjacent thereto and formed in the other element.

The sealing strip 18 is carried through a longitudinal opening 35 (FIGS. 1, 2) formed in the force and/or motion transfer element 9. The transfer element 9 is, in longitudinal cross section, essentially wedge-shaped, or formed with a double wedge-shaped spreading wedge 36 which, preferably, is symmetrical with respect to a central plane extending through the element 9 (see FIG. 1). The double-wedge shaped element 36 also guides the top or outer cover strip 27 over its upper surface. The arrangement is so made that the spreading portion 36 is passed between the strips 18, 27. In the end zones of the force transfer element 9, pressure elements 37—see FIG. 1—are located, acting on the top or outer cover strip 27 and pressing the outer cover strip 27 against the groove 28 in the top surface 1*b* of the cylinder 1. The pressure element 37 which, for example, may be in form of a roller, a rounded pin, or the like, is preferably positioned essentially above the portions of the piston 5 which carry the piston sealing elements 6, 7, such as piston rings, piston sleeves, or O-rings, or the like.

Operation: In the region of the pressure chambers 19, 20, at both sides of the piston 5, the two strips 18, 27 are in engagement, by interengagement of the rib 26 and the longitudinal groove 30—see FIG. 3. Consequently, the inner sealing strip 18 is held in position by the outer cover strip 27, the interengaging holding projection-and-recess rib and groove passing through the longitudinal slit 3. The inner sealing strip 18 is engaged with the surfaces 25 of the wall 102 of the cylinder; the portion 21 thereof is engaged with the sealing surface 22 of the groove, the lateral surfaces 23 guiding the strip.

Let it be assumed that pressure fluid is introduced in chamber 20 through an end connection passing, for example, through the end cap 4 (not shown), and which may be in accordance with any customary arrangement. Chamber 19 is being vented. Pressure fluid, which may be liquid or gaseous, will move or shift piston 5 towards the left, starting from the position in FIG. 1. The wedge-shaped spreader part 36 at the left-hand side will spread the top cover 27 from the sealing strip 18 in the unpressurized zone behind the left side portion of the piston 5, thus squeezing the rib 26 out of the longitudinal groove 30, the legs 29 permitting elastic lateral deflection—see FIG. 4. The left pressure element 37, as well as the piston rings or sealing elements 6 on the left-hand side of the piston prevent undesired separation of the rib 26 and the longitudinal groove 30 at the left side, that is, extending above the chamber 19. Leakage from the chamber 19, therefore, is effectively prevented.

At the right-hand side of the piston, FIG. 1, the sealing element 7 will squeeze together the top or outer strip 27 against the inner strip 18, causing engagement of the rib 26 with the groove 30 at the right side of the piston. This engagement will be continuous, so that the pressurized chamber 20 is always reliably sealed.

Upon reversal, that is, pressurization of chamber 19 and venting of chamber 20, the piston will move to the right, in equivalent operation, but in reverse direction. Leakage of unpressurized fluid from the chamber 20, likewise, is then prevented.

The pressurized fluid with which the cylinder-piston structure can be used can be of any type—liquid or gaseous.

The force transfer element, preferably, is a single unitary structure. It is, of course, also possible to make the force transfer element separable, that is, to separately make the components 10, 11, 12, 17 as separate structures connected, for example, by screw or weld connections.

The guide grooves 16, extending longitudinally along the lateral walls of the cylinder structure, preferably have a centrally triangular shape in cross section, and are located parallel with respect to each other, extending over the length of the cylinder tube 1. The guide strips 14 preferably are made to fit precisely in the guide grooves 16. They have triangular projecting elements and, in general, are prismatic structures, fitted in seating grooves formed in the legs 11 of the yoke 9. The guide strips 14, preferably, are made of low-friction high-strength material, such as plastic, and preferably for example of Teflon (trademark). By screwing screws 15 in-and-out, the position of the guide strips 14 can be adjusted with respect to the grooves 16.

Figure 2A:
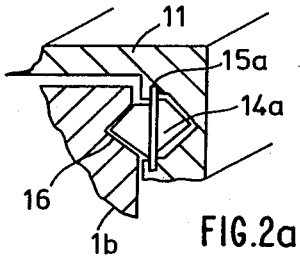
FIG. 2A is a part-perspective transverse cross section illustrating another embodiment of the invention.
Figure 2:
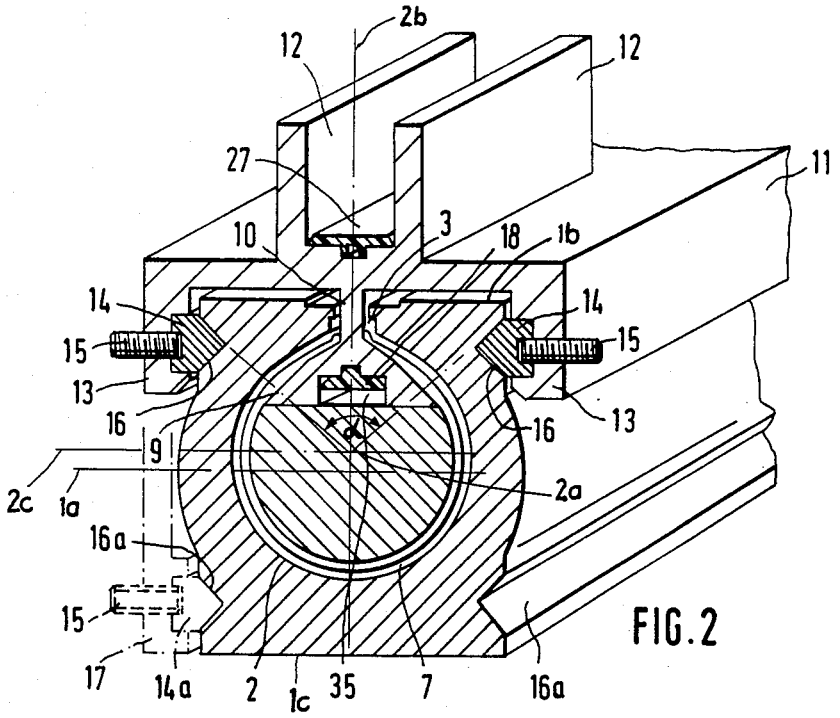
FIG. 2 is a part-perspective transverse cross section along lines II—II of FIG. 1, to a different scale.

Rather than using guide strips 14, other arrangements may be used, such as rollers, roller bearings and the like. Such an arrangement is shown in FIG. 2A where a roller 14*a* of circular cross section is rotatably mounted by pin 15*a* to form a guide element means engageable with the guide tank by rolling engagement. Of course, a reverse arrangement may be used, with projecting elements located on the cylinder 1, and grooves formed in the legs 11 of the yoke, with suitable engagement strips located in one or the other, or both of the elements.

Force due to movement of the piston 5 is transferred directly to the force transfer element 9; any transversely directed forces or torques can readily be accepted by the guide grooves 16 and the guide strips 14, so that movement of the piston 5 in the cylinder is not impaired, and no expansion of the longitudinal slit of the cylinder tube 1 will result. The guide strips 14 are preferably located between the upper surface 1*b* of the cylinder tube 1 and a plane of symmetry 1*a* thereof, and positioned, preferably, at approximately the level of the termination of the longitudinal slit 3. Thus, the guide strips 14 in the yoke 11 tend to compress the cylinder structure 1 in the region of the slit 3 and prevent expansion of the slit 3. Thus, the force transfer element 9, with its guide yoke 11 and the guide elements 14 thereon engaging the grooves 16 and the cylinder, additionally contribute to maintenance of dimension of the cylinder structure, and prevent expansion.

The guide grooves 16 formed in the cylinder have lateral surfaces which, preferably, have an angle $\alpha$ of about 90° with respect to each other, so that each will have an angle of about 45° with respect to a vertical plane of symmetry 2*b*. This provides for uniform acceptance of radial forces of the force transfer element 9 and insures accurate guidance by the guide grooves 16.

The sealing strips 18, 27 are always in engagement with the respective sealing surfaces 22, 25, 28; hang-through of the inner sealing strip 18, or buckling of the outer sealing strip 27 thus is reliably prevented. This is obtained, even in cylinders of substantial length, where the present invention is particularly applicable since, in other structures, long cylinders also require long piston rods—which are avoided in the present structure. The sealing strips are secured together through the slit 3, which is present anyway; thus, separate holder elements need not be used, so that the manufacturing costs for the entire combination can be held low. Forming the inner sealing strip 18 with a sealing body unit 21 and projecting sealing lips 24 provides for reliable engagement and sealing of the cylinder chambers 19, 20 to permit application of fluid under substantial pressure, without leakage. The placement of separate sealing lips 24, with a resilient connection 25' between the sealing lips 24 and the remaining body structure, and particularly the sealing body 21 of the strip 18, permits effective sealing also of cylinders of substantial diameter and accurate matching of the wall 102 of the cylinder 2 with the sealing lips.

The strips 18, 27 preferably are made of elastic plastic material, the characteristics of which must be selected with respect to the mechanical stresses placed thereon, as well as chemical effects due to the pressure fluid which is used. Alternatively, fabric-reinforced rubberized material may also be used.

Various changes and modifications may be made, and features described in connection with any one of the embodiments may be used with any of the others, within the scope of the inventive concept.

I claim:

1. Piston-cylinder structure having an elongated tubular cylinder (1) closed at its end;

an elongated piston (5) slidable in the cylinder;

a slit (3) extending through the wall (102) of the cylinder longitudinally with respect to its axis;

a motion transfer element (9, 12) secured to the piston and having a rib-like portion (10) extending through said slit and to the outside of the cylinder wall (102) movable longitudinally of the cylinder to transfer relative motion between the piston and the cylinder to an external device;

and means for flexibly sealing and closing off the slit in the cylinder in the regions between the closed ends thereof and the rib-like portion (10) of the motion transfer element to seal the piston in portions of the cylinder and define closed cylinder chambers (19, 20) therein, wherein, in accordance with the invention, the sealing means comprises a sealing surface formed in the inside of the cylinder including two sealing shoulders extending towards the slit, inwardly of the cylinder;

two flexible sealing strips (18, 27), one of said strips (18) being an inner strip located inside the cylinder and engaging said inwardly extending sealing shoulders, the other one of said strips (27) being an outer strip located outside of the cylinder and engaging an outer wall portion of the cylinder, and separable, re-engageable elongated resiliently deflectable projection-and-recess means formed on said strips at facing sides and extending through said slit (3), said elongated projection-and-recess means being separable at one side of the piston in conjunction with movement of the piston and hence of said motion transfer element and reconnectable at the other side of the piston to close the slit in the region defining the cylinder chamber, and continue to close the slit upon continued motion of the piston to thus continuously maintain the sealing strip in position covering the slit and to seal the slit and provide a continuously axially changing, sealed cylinder chamber, while permitting opening of the cylinder chamber at said one side of the piston and permit movement of said rib-like portion (10) of the motion transfer element through said slit.

2. Structure according to claim 1, wherein the projection-and-recess means comprises a rib (26) formed on one of said strips (18) and elastically deflectable side walls (29) formed on the other of said strips defining therebetween a U-shaped groove or recess (30).

3. Structure according to claim 2, wherein the rib (26) and the groove (30), in cross section, have at least in part wedge-shaped portions (32, 34), the wedge-shaped portion fitting around and over each other to provide for interlocking engagement of the rib in the groove upon engagement of the rib within the groove.

4. Structure according to claim 3, wherein the rib (26) and the side walls (29) defining therebetween the groove have parallel extending portions **(31, 34*a*) extending at right angles from the respective strip, and positioned adjacent the wedge-shaped portions (32, 34)** to provide for close matching sealing engagement of the rib and the side walls defining the groove.

5. Structure according to claim 3, wherein the rib (26) is formed with a chamfered or relieved head portion (33) to facilitate introduction of the head portion into the groove (30).

6. Structure according to claim 1, wherein the inner sealing strip (18) is formed with a guide body (21), extending transversely with respect to the longitudinal axis **(2*a*) of the cylinder (2)**;

and guide surfaces (22, 23) extending parallel to said longitudinal axis in intersecting planes to provide for positive guidance of said guide body (21) with respect to the slit, the projection of the projection-and-recess means extending from said guide body.

7. Structure according to claim 6, further including sealing lips (24) extending from said guide body and being elastically deflectable with respect thereto;

and sealing surfaces (25) formed on the inner wall (102) of the cylinder (2) positioned for engagement of said sealing lips.

8. Structure according to claim 7, wherein said sealing lips and the adjacent wall portions are shaped to provide for a smoothly merging circumferential surface.

9. Structure according to claim 7, wherein the sealing lips (24), in cross section, are wedge-shaped and have a wider wedge portion resiliently deflectably secured to the guide body (21).

10. Structure according to claim 1, wherein the motion transfer element includes a spreading wedge body (36) having dual wedge surfaces forming pointed end portions and a thicker intermediate portion, the pointed end portions being positioned between said two strips to provide for separation of the strips upon penetration of the pointed end portions therebetween due to movement of the piston (5).

11. Structure according to claim 10, further including compression portions (37) secured to the motion transfer element (9) and engaging the outer one (27) of said strips to press the strips together;

the piston being formed with a piston head, sealingly movably located in the cylinder;

and wherein the pointed end portions are located at least in approximate alignment with the piston head.

12. Structure according to claim 1, wherein the strips comprise elastic plastic material.

13. Structure according to claim 1, wherein the motion transfer element includes a yoke (11) extending laterally over the cylinder (1) at the outside thereof;

and interengaging guide track—guide element means are provided on the cylinder and the yoke, respectively, positioned at the outer surfaces of the cylinder between an end surface (1*b*) of the cylinder spanned by said yoke, and a transverse axis of symmetry (2*a*) of the cylinder to provide for lateral support of the portions of the cylinder separated by the slit and spanned by said yoke.

14. Structure according to claim 13, wherein the interengaging guide track—guide element means comprise guide grooves (16) and guide strips (14) matching, in cross section, the shape of the guide tracks (16).

15. Structure according to claim 14, wherein said guide tracks (16) are grooves formed in the outer walls of the cylinder, and the guide strips are located in the yoke (11) and positioned to fit in said grooves.

16. Structure according to claim 14, wherein a plurality of guide tracks—guide strips are provided and positioned above and below said plane of symmetry.

17. Structure according to claim 16, wherein said plurality of guide tracks and strips are provided in pairs.

18. Structure according to claim 14, wherein said guide tracks are positioned in planes which form an angle ($\alpha$) of about 45° with respect to a longitudinal central plane (2*b*) passing through the cylinder.

19. Structure according to claim 14, wherein the guide tracks (16) are approximately triangular; and the guide strips (14) are approximately prismatic.

20. Structure according to claim 15, wherein said yoke is formed with depending leg portions (11) surrounding the outer lateral walls of the cylinder (1);

and the guide strips (14) project from said outer leg portions towards each other for engagement in the respective guide tracks (16).

21. Structure according to claim 14, wherein the guide strips are made of a wear-resistant, low-friction plastic material.

22. Structure according to claim 15, further including adjustment means (15) adjustably positioning the guide strips within the yoke (11) for adjusting the relative alignment and positioning of the guide strips with respect to the guide tracks.

23. Structure according to claim 13, wherein the interengaging guide track—guide element means include a guide track and low-friction elements engageable with said guide track, by rolling engagement.

24. Structure according to claim 13, wherein the interengaging guide track—guide element means are positioned between the external limit of said slit (3) and the transverse plane of symmetry (2*a*) of the cylinder (2).

25. Piston-cylinder structure having an elongated tubular cylinder (1) closed at its end;

an elongated piston (5) slidable in the cylinder;

a slit (3) extending through the wall (102) of the cylinder longitudinally with respect to its axis;

a motion transfer element (9, 12) secured to the piston (5) and having a rib-like portion (10) extending through said slit and to the outside of the cylinder wall (102), movable longitudinally of the cylinder to transfer relative motion between the piston and the cylinder to an external device;

and means for flexibly sealing and closing off the slit in the cylinder in the regions between the closed ends thereof and the rib-like portion (10) of the motion transfer element to seal the piston in portions of the cylinder and define closed cylinder chambers (19, 20) therein, wherein the motion transfer element includes a yoke (11) extending laterally over the cylinder (1) at the outside thereof;

interengaging guide track—guide element means are provided on the cylinder and the yoke of the motion transfer element, respectively, positioned at the outer surfaces of the cylinder between an end surface (1*b*) of the cylinder spanned by said yoke, and a transverse axis of symmetry (2*a*) of the cylinder to provide for lateral support of the portions of the cylinder separated by the slit and spanned by said yoke; and wherein the interengaging guide track—guide element means comprises guide grooves (16) and guide strips (14) matching, in cross section, the shape of the guide tracks (16).

26. Structure according to claim 25, wherein said guide tracks (16) are grooves formed in the outer walls of the cylinder, and the guide strips are located in the yoke (11) and positioned to fit in said grooves.

27. Structure according to claim 25, wherein a plurality of guide tracks—guide strips are provided and positioned above and below said plane of symmetry.

28. Structure according to claim 25, wherein said guide tracks are positioned in planes which form an angle ($\alpha$) of about 45° with respect to a longitudinal central plane (2*b*) passing through the cylinder.

29. Structure according to claim 26, wherein said yoke is formed with depending leg portions (11) surrounding the outer lateral walls of the cylinder (1);

and the guide strips (14) project from said outer leg portions towards each other for engagement in the respective guide tracks (16).

30. Structure according to claim 25, wherein the guide strips are made of wear-resistant, low-friction plastic material.

31. Structure according to claim 26, further including adjustment means (15) adjustably positioning the guide strips within the yoke (11) for adjusting the relative alignment and positioning the guide strips with respect to the guide tracks.

32. Piston-cylinder structure having an elongated tubular cylinder (1) closed at its end;

an elongated piston (5) slidable in the cylinder;

a slit (3) extending through the wall (102) of the cylinder longitudinally with respect to its axis;

a motion transfer element (9, 12) secured to the piston (5) and having a rib-like portion (10) extending through said slit and to the outside of the cylinder wall (102), movable longitudinally of the cylinder to transfer relating motion between the piston and the cylinder to an external device;

and means for flexibly sealing and closing off the slit in the cylinder in the regions between the closed ends thereof and the rib-like portion (10) of the motion transfer element to seal the piston in portions of the cylinder and define closed cylinder chambers (19, 20) therein, wherein the motion transfer element includes a yoke (11) extending laterally over the cylinder (1) at the outside thereof;

interengaging guide track—guide element means are provided on the cylinder and the yoke of the motion transfer element, respectively, positioned at the outer surfaces of the cylinder between an end surface (1*b*) of the cylinder spanned by said yoke, and a transverse axis of symmetry (2*a*) of the cylinder to provide for lateral support of the portions of the cylinder separated by the slit and spanned by said yoke; and wherein the interengaging guide track—guide element means include a guide track and low-friction elements engageable with said guide track by rolling engagement.

* * * * *